US012084827B2

(12) United States Patent
Segroves et al.

(10) Patent No.: US 12,084,827 B2
(45) Date of Patent: *Sep. 10, 2024

(54) SEDIMENT-CONTROL FENCES WITH ANISOTROPIC STRENGTH AND STIFFNESS PROPERTIES

(71) Applicant: Friendly Environment 14 LP, Shelbyville, TN (US)

(72) Inventors: Thomas Kyle Segroves, Shelbyville, TN (US); Stephen Matthew Sliger, Bell Buckle, TN (US); Kevin Brian Wolfe, Franklin, TN (US); R. Alan Sutton, Gainesville, GA (US)

(73) Assignee: Friendly Environment 14 LP, Shelbyville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/138,059

(22) Filed: Apr. 22, 2023

(65) Prior Publication Data

US 2023/0265633 A1 Aug. 24, 2023

Related U.S. Application Data

(63) Continuation of application No. 16/239,868, filed on Jan. 4, 2019, now Pat. No. 11,634,880.
(Continued)

(51) Int. Cl.
*E02D 17/20* (2006.01)
*E01F 7/02* (2006.01)
(Continued)

(52) U.S. Cl.
CPC ..... *E02D 17/202* (2013.01); *E01F 7/02* (2013.01); *D03D 1/0035* (2013.01); *D03D 15/46* (2021.01);
(Continued)

(58) Field of Classification Search
CPC ..... E02D 17/20; E02D 17/202; E02F 7/02; D03D 1/0035
See application file for complete search history.

(56) References Cited

U.S. PATENT DOCUMENTS 1,964,419 A 6/1931 Asten
4,279,535 A 7/1981 Gagliardi et al.
(Continued)

OTHER PUBLICATIONS

Barrett et al., "An evaluation of geotextiles for temporary sediment control", pp. 283-290, May/Jun. 1998.
(Continued)

*Primary Examiner* — Frederick L Lagman
(74) *Attorney, Agent, or Firm* — Alan G. Towner; Leech Tishman Fuscaldo & Lampl

(57) ABSTRACT

Sediment-control fences designed to withstand hydrostatic forces associated with elevated backwater against the fence are disclosed. The fences are made of anisotropic fabric having different mechanical properties such as strength and stiffness in the machine direction versus the transverse direction. The anisotropic fabric may include fibrillated yarns in one direction and monofilaments in another direction. The sediment-control fences may be used without the necessity of wire or chain-link backed supports that are conventionally used to resist structural failure due to hydraulic overtopping of the fences.

17 Claims, 2 Drawing Sheets

Related U.S. Application Data

(60) Provisional application No. 62/715,347, filed on Aug. 7, 2018, provisional application No. 62/613,648, filed on Jan. 4, 2018.

(51) Int. Cl.
*D03D 1/00* (2006.01)
*D03D 15/46* (2021.01)

(52) U.S. Cl.
CPC ..... *D10B 2505/204* (2013.01); *E02D 2300/0087* (2013.01)

(56) References Cited

U.S. PATENT DOCUMENTS 4,756,511 A 7/1988 Wright, III
5,108,224 A 4/1992 Cabaniss et al.
5,201,497 A 4/1993 Williams et al.
5,616,399 A 4/1997 Theisen
5,735,640 A 4/1998 Meyer et al.
5,758,868 A 6/1998 Shea
5,877,096 A 3/1999 Stevenson et al.
5,954,451 A 9/1999 Presby
7,465,129 B2 * 12/2008 Singleton ..... E02D 17/20 428/221
RE42,695 E 9/2011 Singleton
8,465,231 B2 * 6/2013 Christopher ..... E03F 1/00 256/12.5
8,747,027 B1 * 6/2014 Singleton ..... E02D 3/005 405/302.6
8,882,399 B2 * 11/2014 Ortega ..... D04H 13/00 405/302.7
10,024,022 B2 * 7/2018 Booth ..... D03D 13/008
10,145,080 B2 12/2018 Segroves et al.
11,634,880 B2 * 4/2023 Segroves ..... E01F 7/02 256/12.5
2002/0172564 A1 11/2002 Brown
2004/0076482 A1 4/2004 Singleton
2006/0133900 A1 6/2006 Singleton
2007/0069191 A1 3/2007 Arnold et al.
2007/0217871 A1 * 9/2007 Kerman ..... E02D 17/20 405/302.6
2008/0086808 A1 * 4/2008 Sutton ..... D03D 15/47 28/143
2008/0112766 A1 5/2008 Kerman
2011/0305530 A1 12/2011 Hunt
2012/0077005 A1 3/2012 Chen et al.
2014/0072375 A1 3/2014 Ortega
2014/0154018 A1 6/2014 Singleton
2015/0159305 A1 * 6/2015 Booth ..... E02D 17/202 442/189
2016/0362865 A1 * 12/2016 Segroves ..... E02D 17/202
2017/0354907 A1 * 12/2017 Ray ..... D03D 15/37
2018/0320332 A1 * 11/2018 Booth ..... D03D 13/008

OTHER PUBLICATIONS

Henry et al., "Silt Fence Testing for Eagle River Flats Dredging", Special Report 95-27, pp. 1-9 and 11-14, Dec. 1995.
Ingold, "The Geotextiles and Geomembranes Manual", First Edition, Introduction, pp. 1-70, 1994.
Koerner, "Designing with Geosynthetics", Fourth Edition pp. 27-33, Jul. 1999.
Natural Resources Conservation Service, Wisconsin DNR, "Sediment Basin (No.) Code 350", pp. 1-7, Sep. 1990.
The International Search Report of the International Searching Authority for International Application No. PCT/US2016/037030, 3 pages.

* cited by examiner

SEDIMENT-CONTROL FENCES WITH ANISOTROPIC STRENGTH AND STIFFNESS PROPERTIES

CROSS-REFERENCE TO RELATED APPLICATION

This application is a continuation of U.S. patent application Ser. No. 16/239,868 filed Jan. 4, 2019, now U.S. Pat. No. 11,634,880 issued Apr. 25, 2023, which claims priority from U.S. Provisional Application Nos. 62/613,648 filed Jan. 4, 2018 and 62/715,347 filed Aug. 7, 2018, all of which are incorporated herein by reference.

FIELD OF THE INVENTION

The present invention is related to geotextile sediment-control fences that have anisotropic mechanical properties in their machine and transverse directions.

BACKGROUND INFORMATION

Silt fences have been installed in topographically low areas where concentrated flow will collect, often resulting in the overtopping and failure of such fencing. Conventional silt fences have not been structurally capable of resisting the forces associated with high water depths accumulating behind the fence and hydrodynamic forces associated with overtopping. Recent developments in silt fencing include hybrid fabrics with graduated sections of geotextile material having increasing water flux rates directly correlating with increasing fence height. However, these hybrid-fabric fences are not effective in preventing overtopping due to the overwhelming magnitude of runoff flow rates associated with storm events. Wire or chain-link backing has been used on silt fences in order to provide added tensile strength and high-modulus support so that the fabric portion of the fence does not excessively deflect/elongate/sag and ultimately fail due to high tensile stresses, fabric tearing and overtopping.

U.S. Pat. No. 10,145,080, issued Dec. 4, 2018, which is incorporated herein by reference, discloses sediment-control fences made of woven geotextile fabrics that are structurally enhanced with reinforcing straps.

SUMMARY OF THE INVENTION

The present invention provides sediment-control fences designed to withstand hydrostatic forces associated with elevated backwater. The fences are made of anisotropic fabric having different mechanical properties such as strength and stiffness in the machine direction versus the transverse direction. The fabric may include fibrillated yarns in one direction and monofilaments in another direction. The sediment-control fences of the present invention may be used without the necessity of wire or chain-link backed supports that are conventionally used to resist structural failure due to hydraulic overtopping of the fences.

An aspect of the present invention is to provide a sediment-control fence comprising an anisotropic fabric having a lower grade line and an upper edge defining an installed height extending between the lower grade line and the upper edge, the anisotropic fabric comprising fibrillated yarn running in a transverse direction substantially parallel with the installed height, and fibrillated yarn running in a machine direction substantially parallel with a length of the anisotropic fabric, wherein a tensile strength of the anisotropic fabric in the machine direction remains substantially constant along the installed height.

Another aspect of the present invention is to provide a sediment-control fence system comprising: anchoring posts; and a sediment-control fence for attachment to the anchoring posts comprising an anisotropic fabric having a lower grade line and an upper edge defining an installed height extending between the lower grade line and the upper edge, the anisotropic fabric comprising fibrillated yarn running in a transverse direction substantially parallel with the installed height, and fibrillated yarn running in a machine direction substantially parallel with a length of the anisotropic fabric, wherein a tensile strength of the anisotropic fabric in the machine direction remains substantially constant along the installed height.

These and other aspects of the present invention will be more apparent from the following description.

DETAILED DESCRIPTION

The present invention provides sediment-control fences including anisotropic geotextile materials that are water permeable. An upper portion of the sediment-control fence forms a vertical wall above the ground surface when the sediment-control fence is installed at a site, while a lower anchoring portion of the sediment-control fence is located below grade when the sediment-control fence is installed. An anchoring guide line may be marked at the intersection of the upper and lower portions in order to help install the sediment-control fence at the appropriate level.

Figure 1:
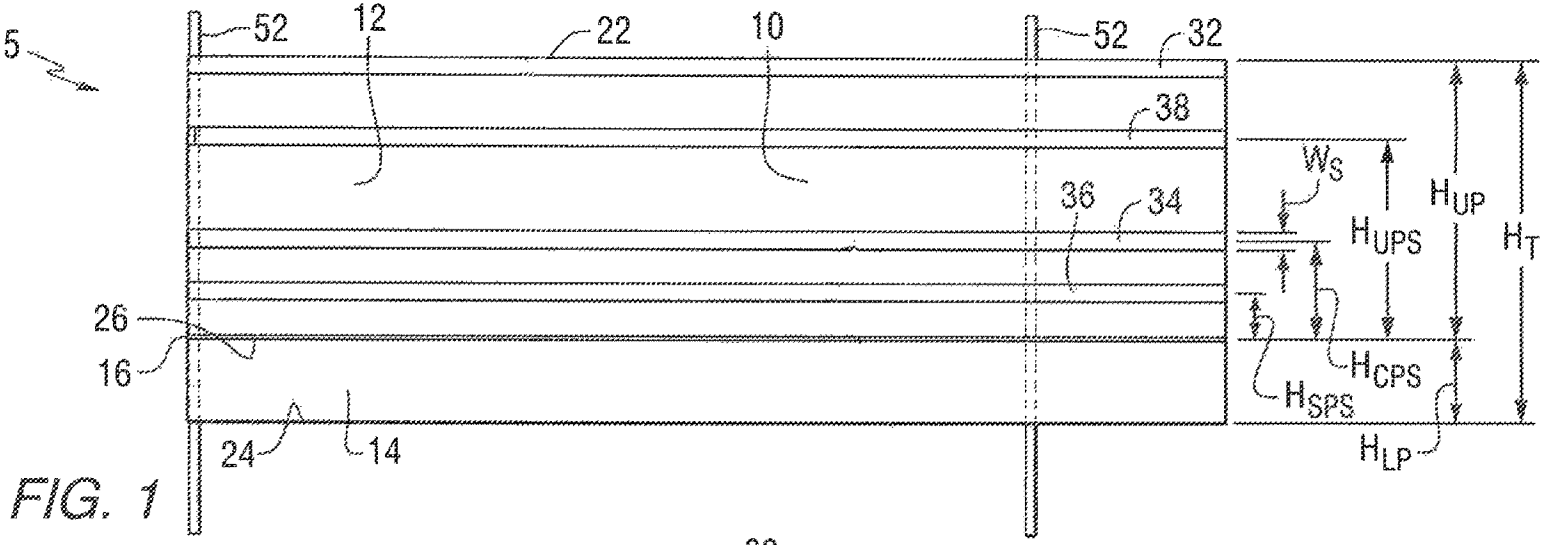
FIG. 1 is a partially schematic front view of a sediment-control fence in accordance with an embodiment of the present invention.
Figure 2:
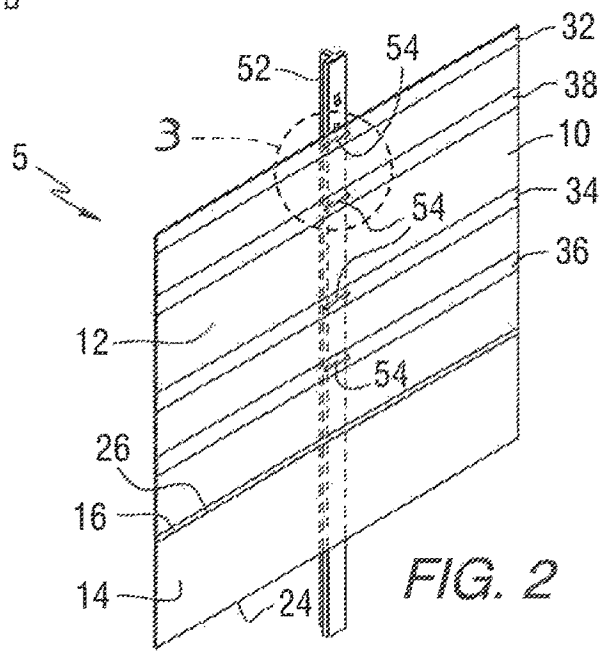
FIG. 2 is an isometric view of the sediment-control fence of FIG. 1.

FIGS. 1 and 2 schematically illustrate a sediment-control fence 5 comprising woven anisotropic geotextile fabric 10 in accordance with an embodiment of the present invention. The anisotropic fabric 10 is water permeable and has sufficient mechanical properties to avoid the necessity of using conventional wire or chain link fencing supports when installed in the field. An upper portion 12 of the sediment-control fence 5 forms a vertical wall above the ground surface when the sediment-control fence 5 is installed at a site, while a lower anchoring portion 14 of the sediment-control fence 5 is located below grade when the sediment-control fence is installed. An anchoring guide line 16 may be marked at the intersection of the upper and lower portions 12, 14 in order to help install the sediment-control fence 5 at the appropriate level.

In accordance with certain embodiments, the upper portion 12 has an upper edge 22 and the lower portion 14 has a bottom edge 24. When the lower portion 14 is secured below grade, a lower grade line 26 of the sediment-control fence 5 is formed. The lower grade line 26 is formed at the portion of the sediment-control fence 5 intersecting the ground surface. As shown in FIGS. 1 and 2, the lower grade line 26 may be formed at the anchoring line 16.

As shown in FIG. 1, the anisotropic geotextile fabric 10 of the sediment-control fence 5 has a total height $H_T$, the upper portion 12 has a height $H_{UP}$ and the lower portion 14 has a height $H_{LP}$. The upper portion 12 height $H_{UP}$ may also be considered the installed height as measured between the lower grade line 26 and the upper edge 22. The lower portion 14 height $H_{LP}$ may be defined from the lower grade line 26 to the bottom edge 24. The dimensions of the sediment-control fence 5 may be varied depending on the intended use thereof. For example, the total height $H_T$ of the sediment-control fence 5 may range from 1.5 to 6 feet, or from 2 to 5.5 feet, or from 2.5 to 5 feet. In certain embodiments, the total height $H_T$ may be 36 inches or 42 inches. The upper portion 12 height $H_{UP}$ may range from 1 to 5 feet, or from 1.5 to 4.5 feet, or from 2 to 4 feet. In certain embodiments, the upper portion height $H_{UP}$ may be 30 inches or 34 inches. The lower portion 14 height $H_{LP}$ may range from zero to 2 feet, or from 2 to 18 inches, or from 4 to 14 inches.

As shown in FIGS. 1 and 2, the upper portion 12 of the sediment-control fence 5 may include marking stripes 32, 34, 36 and 38 along the fence profile which run along the length of the sediment-control fence 5, e.g., along the longitudinal or machine direction of the anisotropic fabric 10. The marking stripes 32, 34, 36 and 38 may be of a different color or appearance from the remainder of the fabric in order to provide guidance to a user when installing the fence on support posts, as more fully described below. The marking stripes 32, 34, 36 and 38 may be non-reinforcing, i.e., the striped portions have substantially the same mechanical properties such as tensile strength, elongation, stiffness and modulus as the remainder of the fence fabric. For example, the grab tensile strength and elongation as measured according to the ASTM D-4632 standard test in the machine direction at the location of a marking stripe may be the same as the ASTM D-4632 machine-direction grab tensile strength and elongation measured at a location of the fabric that does not include a marking stripe. The anisotropic fabric 10 and sediment-control fence 5 are thus non-reinforced by the marking stripes 32, 34, 36, and 38. While four marking stripes 32, 34, 36 and 38 are shown in the embodiment of FIGS. 1 and 2, the sediment-control fence 5 of the present invention may have any other desired number of marking stripes, such as zero, one, two, three, five, six or more marking stripes. In certain embodiments, the marking stripes may include a top stripe 32, primary center of pressure marking stripe 34, secondary center of pressure marking stripe 36 and upper pressure marking stripe 38. In accordance with embodiments of the invention, the marking stripes 34, 36 and 38 may be located at controlled heights from the lower grade line 26, as measured from the center of each pressure stripe to the lower grade line 26.

The primary center of pressure marking stripe 34 may be located at a height $H_{CPS}$ from the lower grade line 26, as shown in FIG. 1. As more fully described below, the height $H_{CPS}$ of the primary center of pressure marking stripe 34 may correspond to a center of pressure at overtopping. As used herein, the term "center of pressure at overtopping" means the height $H_{CP}$ of the center of pressure when the water level behind the sediment-control fence 5 is at the upper edge 22 of the sediment-control fence 5. In accordance with an embodiment of the present invention, the height $H_{CP}$ of the center of pressure at overtopping falls within the width $W_S$ of the primary center of pressure marking stripe 34. For example, the height $H_{CP}$ of the center of pressure at overtopping may be equal to the height $H_{CPS}$ of the primary center of pressure marking stripe 34 measured at the midpoint of the width $W_S$ of the primary center of pressure marking stripe 34.

The secondary center of pressure marking stripe 36 may be located at a height $H_{SPS}$ from the lower grade line 26, as shown in FIG. 1. As more fully described below, the height $H_{SPS}$ of the secondary center of pressure marking stripe 36 corresponds to a center of pressure at half overtopping. As used herein, the term "center of pressure at half overtopping" means the height $H_{CP}$ of the center of pressure when the water level behind the sediment-control fence 5 is halfway to the upper edge 22 of the sediment-control fence 5 from the ground surface. In accordance with an embodiment of the present invention, the height $H_{CP}$ of the center of pressure at half overtopping falls within the width $W_S$ of the secondary center of pressure marking stripe 36. For example, the height $H_{CP}$ of the center of pressure at half overtopping may be equal to the height $H_{SPS}$ of the secondary center of pressure marking stripe 36 measured at the midpoint of the width $W_S$ of the secondary center of pressure marking stripe 36.

The upper pressure marking stripe 38 may be located at a height $H_{UPS}$ from the lower grade line 26, as shown in FIG. 1. In certain embodiments, the height $H_{UPS}$ of the upper pressure marking stripe 38 is located at or above the midpoint between the top stripe 32 and the primary center of pressure marking stripe 34. In a particular embodiment, the entire width $W_S$ of the upper pressure marking stripe 36 is located at or above the midpoint between the top stripe 32 and the primary center of pressure marking stripe 34.

Figure 4:
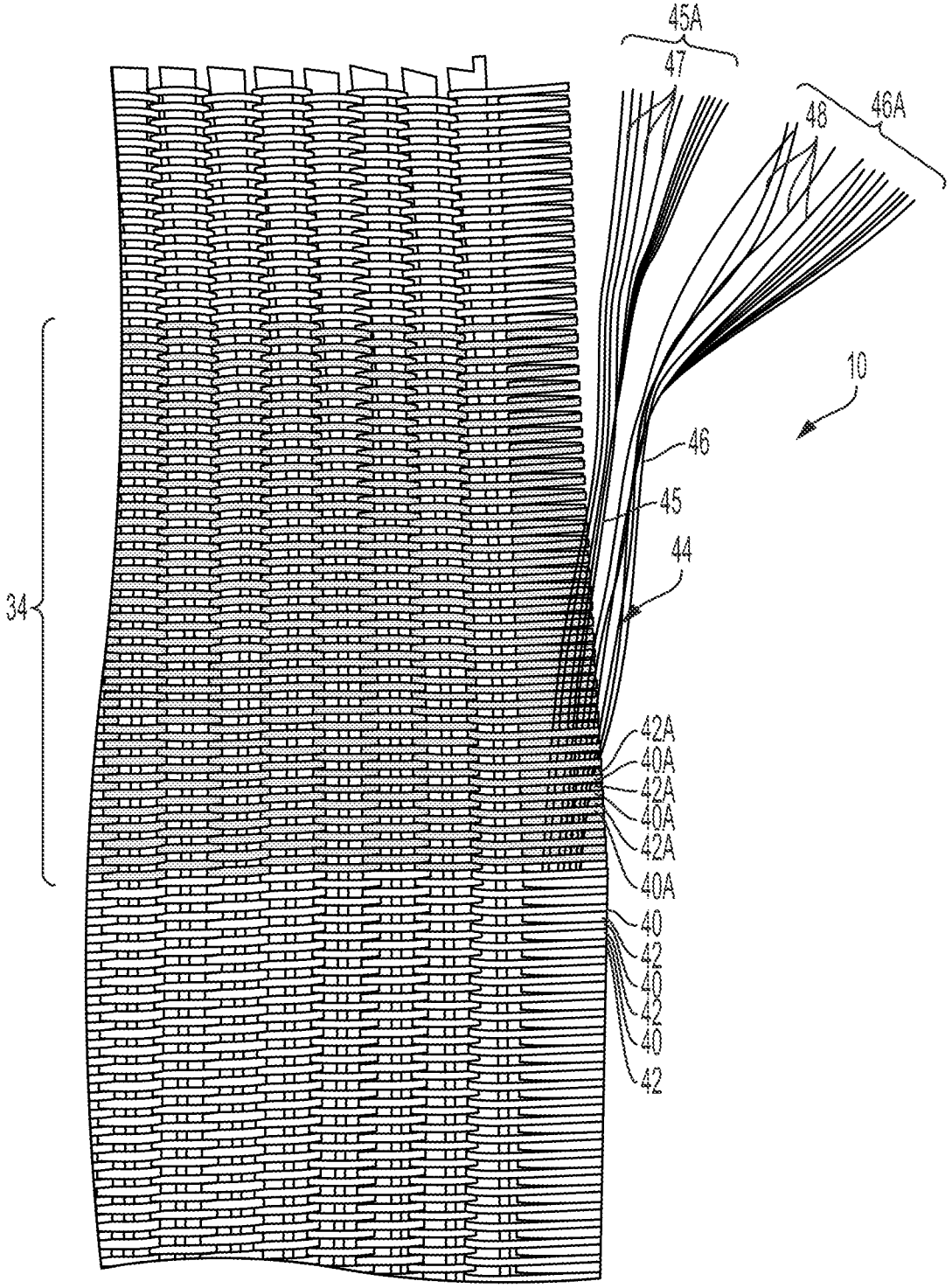
FIG. 4 is a photograph of a portion of sediment-control fence including an anisotropic fabric with fibrillated yarns in the transverse direction and monofilaments in the machine direction in accordance with an embodiment of the prevent invention.

FIG. 4 illustrates details of an anisotropic fabric 10 of a sediment-control fence 5 in accordance with an embodiment of the present invention. The anisotropic fabric 10 is a double pick plain weave including monofilaments 40 and 42 running in the machine direction and fibrillated yarn 44 running in the transverse direction. In the region of the marking stripe 34, the machine-direction monofilaments 40A and 42A are of a different color than the remainder of the machine-direction monofilaments 40 and 42. Although the machine-direction monofilaments 40A and 42A are of different color, their mechanical and physical characteristics are otherwise the same or similar to the machine-direction monofilaments 40 and 42.

As further shown in FIG. 4, the anisotropic fabric 10 includes transverse-direction fibrillated yarns 44. In the embodiment shown, each fibrillated yarn 44 comprises a first fibrillated strand 45 and a second fibrillated strand 46, which together form a single fibrillated yarn 44 running in the transverse direction. Although two fibrillated yarn strands 45 and 46 are shown in the embodiment of FIG. 4, any other suitable number of fibrillated strands may be used to form a fibrillated yarn 44 in the transverse-direction, e.g., one fibrillated strand, three fibrillated strands, etc.

In FIG. 4, an end of the fibrillated strand 45 is labeled 45A and has been pulled away from the machine-direction monofilaments 40, 42, 40A and 42A. The fibrillated strand 45 includes multiple fibrils 47 that make up the strand 45 and 45A. Similarly, an end of the fibrillated strand 46 labeled 46A has been pulled away from the machine-direction monofilaments 40, 42, 40A and 42A. The fibrillated strand 46 includes multiple fibrils 48 that make up the fibrillated strand 46 and 46A.

During the weaving process, the fibrillated strands 45 and 46 may be placed next to each other and held in tension to provide a relatively tight bundle of the fibrils 47 and 48 during the weaving process. The resultant transverse-direction fibrillated yarn 44 with its multiple fibrils 47 and 48 is held in position by the machine-direction monofilaments 40, 42, 40A and 42A.

The machine-direction filaments 40, 42, 40A and 42A may comprise polymeric monofilaments such as polypropylene or the like. The cross-sectional shape of each monofilament may be selected as desired, for example, the cross-sectional shape of each monofilament 40, 42, 40A and 42A may be generally round, ovular, rectangular, square or the like. In one embodiment, the cross-sectional shape is ovular. The width of each machine-direction monofilament may typically range from 0.01 to 0.1 inch, for example, from 0.02 to 0.05 inch, or from 0.025 to 0.035 inch.

The denier of each machine-direction monofilament may typically range from 500 to 3,000 denier, for example, from 1,000 to 2,000 denier, or from 1,200 to 1,500 denier. In a particular embodiment, the denier of the machine-direction monofilaments may be 1,350 denier. The denier values described herein are measured according to the standard ASTM D-1907.

In certain embodiments, the tensile strength of each machine-direction monofilament may be greater than 10 pounds, or greater than 15 pounds. For example, the monofilament tensile strength may range from 10 to 40 pounds, or from 15 to 25 pounds. The elongation of the machine-direction monofilament may typically be greater than 8 percent, for example, greater than 10 percent. In certain embodiments, the elongation of each monofilament may be from 8 to 20 percent, or from 10 to 15 percent.

In certain embodiments, the denier of each transverse-direction fibrillated yarn 44 may be from 3,000 to 6,000 denier, for example, from 4,000 to 5,000 denier, in a particular embodiment, the denier of each transverse-direction fibrillated yarn 44 may be 4,600 denier.

Each transverse-direction fibrillated yarn 44 may have a typical yield strength of greater than 20 pounds, for example, greater than 30 pounds. In certain embodiments, the tensile strength of each transverse-direction fibrillated yarn 44 may be from 20 to 100 or 120 pounds, for example, from 30 to 60 or 70 pounds. The elongation of each transverse-direction fibrillated yarn 44 may typically be greater than 10 percent. For example, greater than 12 percent. In certain embodiments, the elongation of each transverse-direction fibrillated yarn 44 may be from 10 to 25 percent, for example, from 12 to 20 percent.

In certain embodiments, the anisotropic fabric 10 has a thickness greater than 0.03 inch, for example, greater than 0.04 inch. For example, the thickness of the anisotropic fabric may be from 0.04 to 0.1 inch, or from 0.045 to 0.6 inch. In a particular example, a sediment-control fence 5 having an overall height of 42 inches may have a thickness of 0.048 inch, while a sediment-control fence 5 having an overall height of 36 inches may have a thickness of 0.045 inch.

In certain embodiments, the anisotropic fabric 10 may include from 3 to 20 of the fibrillated yarns 44 per inch measured in the machine direction perpendicular to the lengths of the fibrillated yarns 44. For example, 4 to 20 per inch, 5 to 15 per inch, or 6 to 12 per inch. For the double pick plain weave fabric 10 shown in FIG. 4, the number of fibrillated strands 45 and 46 per inch may be doubled since each fibrillated yarn 44 comprises a first fibrillated strand 45 and a second fibrillated strand 46.

In certain embodiments, the anisotropic fabric 10 may include from 20 to 50 of the machine-direction monofilaments 40, 42, 40A and 42A per inch measured in the transverse direction perpendicular to the lengths of the monofilaments, for example, from 25 to 40 monofilaments per inch, or from 30 to 38 monofilaments per inch.

In certain embodiments, each fibrillated strand 45 and 46 may be made by extruding a thin sheet of polypropylene, cutting the sheet into strips, fibrillating the strips by conventional cutting/slitting techniques, e.g., to form fibrillated sheets 45A and 46A, as shown in FIG. 4. During weaving operations, the fibrillated strands 45 and 46 may be placed in tension to provide a relatively tight bundle of the fibrils 47 and 48. The resultant weave pattern shown in FIG. 4 provides relatively large loft or thickness in comparison with conventional plain weave monofilament fabrics. As shown in FIG. 4, while the anisotropic fabric 10 possesses desirable water permeability properties for use in the sediment-control fence 5, the weave pattern provides the appearance of a continuous sheet of material with little or no visual openings between the machine-direction and transverse-direction yarns. Such a weave pattern reduces direct flow of water through the fabric 10 in a direction normal or perpendicular to the plane of the fabric, and promotes diagonal flow and/or flow in directions that are not normal to the plane of the anisotropic fabric 10 to provide a torturous flow path. Such a flow path may include flow between adjacent machine-direction monofilaments and transverse-direction fibrillated yarns, as well as flow through adjacent fibrils within each transverse-direction fibrillated yarn.

In accordance with certain embodiments, the sediment-control fence fabric is anisotropic with yarns or filaments having different physical and/or mechanical properties in the machine direction versus the transverse direction. The anisotropic fabric may have any suitable fabric weight. For example, the fabric weight may be at least 50 gsm, or from 100 to 400 gsm.

In accordance with certain embodiments, the permeable anisotropic geotextile fabric material may comprise woven filaments. For example, any suitable polymeric material can be used for the filaments of the woven permeable geotextile material of the sediment-control fence, such as, polypropylene, polyester, polyethylene, polyethylene terephthalate, polyamide, nylon, rayon, fiberglass, polyvinylidene chloride, polytetrafluoroethylene (Teflon), aromatic polyamide aramid (Nomex), acrylic polymers, polyolefin and poly para-phenyleneterephthalamide (Kevlar) may be used. In certain embodiments, the filaments of the woven permeable geotextile material may be polypropylene. Such polypropylene filaments may be formed during an extrusion process.

The denier of the transverse-direction fibrillated yarns 44 may be at least 10 percent greater than the denier of the machine-direction monofilaments 40, 42, 40A and 42A, for example, at least 25 percent, 50 percent or 75 percent greater. For example, the denier of the transverse-direction fibrillated yarns 44 may be from 100 to 1,000 percent greater, for example, from 200 to 800 percent greater, or from 300 to 600 percent greater than the denier of the machine-direction monofilaments.

Although machine-direction monofilaments are described above, the machine-direction filaments may be provided in any other suitable configuration, such as multifilament, slit tape, fibrillated and the like. For example, the machine-direction yarn of the anisotropic fabric 10 may be a monofilament polypropylene filament and the transverse direction yarns may be a fibrillated tape polypropylene. The filaments may be any suitable cross-section shape such as semicircular, ovular, rectangular, triangular, flat, round, hexagonal, x-shaped and the like. For example, the filaments of the permeable geotextile material may comprise a substantially ovular cross-section. In the embodiment shown, the sediment-control fence, including the upper portion and the lower portion, is made of a substantially consistent permeable geotextile material. The substantially consistent permeable geotextile material results in a single flow, as more fully described below. In another embodiment, the permeable geotextile material may be varied along the height of the sediment-control fence.

In accordance with certain embodiments, the selected yarns and filaments of the anisotropic fabric 10 may be loaded into a loom in the machine and transverse directions. The selected filaments may then be loomed or woven into the desired panel size using a selected weave such as plain, satin, twill, oxford, 3-dimensional or tubular, basket, leno, mock leno weaves and the like. For example, the permeable geotextile material may be woven using a plain weave.

In accordance with certain embodiments, the permeable anisotropic fabric 10 may be designed to meet certain minimum specifications, such as minimum average roll values (MARV5). As used herein, the term "minimum average roll value" or "MARV" corresponds to the mean value for a selected property of the sediment-control fence minus two standard deviations. It is to be understood that MARVs individually, and in combination, may be adjusted as desired in order to achieve the desired performance characteristics.

In accordance with certain embodiments, the anisotropic fabric 10 of the sediment-control fence 5 may have an ultimate grab tensile strength in the machine direction MARV of greater than 350 lbs, or at least 360 lbs, or at least 380 lbs, or at least 400 lbs, or at least 450 lbs, or at least 500 lbs, or at least 600 lbs, as measured according to the ASTM D4632 standard. The term "ASTM" means American Society for Testing and Materials. The machine-direction grab strength may typically range from 360 to 3,700 lbs or more, for example, from 380 to 1,500 lbs, or from 400 to 1,250 lbs, or from 500 to 1,000 lbs, as measured according to the ASTM D4632 standard.

In accordance with certain embodiments, the anisotropic fabric 10 of the sediment-control fence 5 may have an ultimate grab tensile strength in the transverse direction MARV of at least 370 lbs, or at least 390 lbs, or least 400 lbs, as measured according to the ASTM D4632 standard. The ultimate grab tensile strength in the transverse direction MARV may typically range from 370 to 3,700 lbs or more, for example, from 390 to 1,500 lbs, or from 400 to 1,000 lbs, as measured according to the ASTM D4632 standard.

In accordance with certain embodiments, the anisotropic fabric 10 of the sediment-control fence 5 may have a modulus in the machine direction of at least 1,000 lbs/ft, or at least 10,000 lbs/ft, or least 25,000 lbs/ft, or at least 45,000 lbs/ft, as measured according to the ASTM D4595 standard, which provides both the material ultimate tensile strength and elongation (i.e., strain), and using the calculation for modulus. The modulus in the transverse direction may be at least 1,000 lbs/ft, or at least 10,000 lbs/ft, or least 25,000 lbs/ft, or at least 50,000 lbs/ft. As used herein, the term "calculation for modulus" means taking the ultimate tensile strength of the material (force units) and dividing the ultimate tensile strength by the elongation (using the decimal value of the % elongation). The modulus in the machine direction may typically range from 500 to 100,000 lbs/ft or more, for example, from 15,000 to 75,000 lbs/ft, or from 25,000 to 60,000 lbs/ft, as measured according to the ASTM D4595 standard and using the calculation for modulus. The modulus in the transverse direction may typically range from 500 to 100,000 lbs/ft or more, for example, from 15,000 to 75,000 lbs/ft, or from 25,000 to 65,000 lbs/ft, as measured according to the ASTM D4595 standard and using the calculation for modulus.

In accordance with certain embodiments, the anisotropic fabric 10 of the sediment-control fence 5 may have an apparent opening size, a flux and a permittivity. For example, the apparent opening size MARV of the woven permeable geotextile material may be from No. 20 (0.85 mm) to No. 200 Sieve (0.075 mm), or from No. 25 (0.7 mm) to No. 120 Sieve (0.125 mm), or from No. 30 (0.6 mm) to No. 70 Sieve (0.212 mm), as measured according to the ASTM D4751 standard. The clean-water flux MARV of the woven permeable geotextile material may be from 10 to 200 gpm/ft$^2$ or more, or from 20 to 125 gpm/ft$^2$, or from 25 to 100 gpm/ft$^2$, as measured according to the ASTM D4491 standard. The permittivity MARV of the woven permeable geotextile material may be from 0.1 to 3.0 sec$^{-1}$ or more, or from 0.2 to 2.0 sec$^{-1}$, or from 0.3 to 1.5 sec$^{-1}$, as measured according to the ASTM D4491 standard.

In accordance with certain embodiments, the anisotropic fabric of the sediment-control fence 5 may have a substantially consistent apparent opening size, clean-water flux and permittivity along the upper portion height $H_{UP}$ of sediment-control fence. This results in a single rate of water flow through the permeable geotextile material of the sediment-control fence.

In accordance with certain embodiments, the anisotropic fabric 10 of the sediment-control fence 5 may have a CBR puncture MARV of at least 200 lbs, or at least 600 lbs, or at least 800 lbs, as measured according to the ASTM D6241 standard. The term "CBR" means California Bearing Ratio. The CBR puncture MARV measured of the permeable anisotropic woven geotextile fabric material of the sediment-control fence may typically range from 200 to 4,000 lbs or more, for example, from 600 to 3,500 lbs, or from 800 to 3,000 lbs, as measured according to the ASTM D6241 standard. Alternatively, the permeable anisotropic woven geotextile fabric material of the sediment-control fence may have a pin puncture MARV of at least 100 lbs, or at least 150 lbs, or at least 175 lbs, as measured according to the ASTM D4833 standard. The pin puncture MARV of the permeable anisotropic woven geotextile fabric material of the sediment-control fence may typically range from 100 to 1,000 lbs or more, for example, from 150 to 750 lbs, or from 175 to 500 lbs, as measured according to the ASTM D4833 standard.

In accordance with certain embodiments, the anisotropic fabric 10 of the sediment-control fence 5 may have a trapezoidal tear in the machine direction MARV of at least 75 lbs, or at least 100 lbs, or at least 150 lbs, as measured according to the ASTM D4533 standard. The trapezoidal tear in the machine direction MARV of the anisotropic fabric may typically range from 75 to 2,000 lbs or more, for example, from 100 to 1,000 lbs, or from 150 to 500 lbs, as measured according to the ASTM D4533 standard.

In accordance with certain embodiments, the anisotropic fabric 10 of the sediment-control fence 5 may have a trapezoidal tear in the transverse direction MARV of at least 75 lbs, or at least 100 lbs, or at least 150 lbs, as measured according to the ASTM D4533 standard. The trapezoidal tear in the transverse direction MARV of the anisotropic fabric may typically range from 75 to 2,000 lbs or more, for example, from 100 to 1,000 lbs, or from 150 to 500 lbs, as measured according to the ASTM D4533 standard.

In accordance with certain embodiments, the anisotropic fabric 10 of the sediment-control fence 5 may have a mullen burst MARV of at least 400 psi, or at least 750 psi, or at least 1,000 psi, as measured according to the ASTM D3786 standard. The mullen burst MARV may typically range from 400 to 4,500 psi or more, for example, from 500 to 3,000 psi, or from 1,000 to 2,000 psi, as measured according to the ASTM D3786 standard.

In accordance with certain embodiments, the anisotropic fabric 10 of the sediment-control fence 5 may have an UV stability MARV of at least 75 percent tensile strength retained in the machine direction, or at least 85 percent tensile strength retained in the machine direction, or at least 90 percent tensile strength retained in the machine direction, as measured according to the ASTM D4355 standard. The UV stability MARV of the anisotropic fabric may typically range from 75 to 100 percent tensile strength retained in the machine direction, for example, from 85 to 100 percent tensile strength retained in the machine direction, or from 90 to 100 percent tensile strength retained in the machine direction, as measured according to the ASTM D4355 standard.

A high-strength and stiffness anisotropic fabric 10 in accordance with an embodiment of the present invention comprises high-tenacity polypropylene yarns is described in Table 1 below.

TABLE 1

| Weave Type | Plain |
|---|---|
| MD Yarn Type | 1,350 denier monofilament polypropylene |
| TD Yarn Type | 4,600 denier fibrillated tape polypropylene |
| MD Yarn Tensile Strength | 16 lbs |
| TD Yarn Tensile Strength | 46 lbs |
| MD Yarn % Elongation | 10.5% |
| TD Yarn % Elongation | 12% |

Permeable anisotropic woven geotextile fabric in accordance with an embodiment of the present invention meets the following Minimum Average Roll Values when tested with the standardized methods listed below in Table 2.

TABLE 2

| Property | Test Method | Value (English Units) |
|---|---|---|
| Construction | ASTM D-3775 | 34 (warp) × 12 (fill) |
| Weave | Visual | Plain Weave |
| Machine Direction Yarn | ASTM D-1907 | 1,350 denier monofilament PP |
| Transverse Direction Yarn | ASTM D-1907 | 4,600 denier fibrillated PP |
| Grab Tensile Strength | ASTM D-4632 | 475 lbs (MD) × 440 lbs (TD) |
| Grab Elongation | ASTM D-4632 | 19% (MD) × 17% (TD) |
| Wide Width Tensile Strength | ASTM D-4595 | 4,800 lbs/ft (MD) × 4,800 lbs/ft (TD) |
| Wide Width Elongation | ASTM D-4595 | 10% (MD) × 10% (TD) |
| Puncture | ASTM D-4833 | 195 lbs |
| Mullen Burst | ASTM D-3786 | 1,200 psi |
| Trapezoidal Tear | ASTM D-4533 | 180 lbs (MD) × 180 lbs (TD) |
| Weight | ASTM D-6566 | 12.4 oz/sy |
| UV Resistance (% Retained at 500 Hrs) | ASTM D-4355 | 80% (MD) |
| Apparent Opening Size | ASTM D-4751 | 20 US std sieve |
| Permittivity | ASTM D-4491 | 0.40 $sec^{-1}$ |
| Water Flow Rate | ASTM D-4491 | 30 $gal/min/ft^2$ |

A high-strength and stiffness anisotropic fabric in accordance with an embodiment of the present invention comprises high-tenacity polypropylene yarns is described in Table 3 below.

TABLE 3

| Weave Type | Plain |
|---|---|
| MD Yarn Type | 1,350 denier monofilament polypropylene |
| TD Yarn Type | 4,600 denier fibrillated tape polypropylene |
| MD Yarn Tensile Strength | 16 lbs |
| TD Yarn Tensile Strength | 46 lbs |
| MD Yarn % Elongation | 10.5% |
| TD Yarn % Elongation | 12% |

A permeable anisotropic woven geotextile fabric in accordance with an embodiment of the present invention meets the following Minimum Average Roll Values when tested with the standardized methods listed below in Table 4.

TABLE 4

| Property | Test Method | Value (English Units) |
|---|---|---|
| Construction | ASTM D-3775 | 34 (warp) × 11 (fill) |
| Weave | Visual | Plain Weave Double Pick |
| Machine Direction Yarn | ASTM D-1907 | 1,350 denier monofilament PP |
| Transverse Direction Yarn | ASTM D-1907 | 4,600 denier fibrillated PP |
| Grab Tensile Strength | ASTM D-4632 | 475 lbs (MD) × 350 lbs (TD) |
| Wide Width Tensile Strength | ASTM D-4595 | 4,800 lbs/ft (MD) × 4,000 lbs/ft (TD) |
| Wide Width Elongation | ASTM D-4595 | 10% (MD) × 12% (TD) |
| Puncture | ASTM D-4833 | 195 lbs |
| Mullen Burst | ASTM D-3786 | 900 psi |
| Trapezoidal Tear | ASTM D-4533 | 180 lbs (MD) × 180 lbs (TD) |
| UV Resistance (% Retained at 500 Hrs) | ASTM D-4355 | 80% (MD) |
| Apparent Opening Size | ASTM D-4751 | 20 US std sieve |
| Permittivity | ASTM D-4491 | 0.27 $sec^{-1}$ |
| Water Flow Rate | ASTM D-4491 | 18 $gal/min/ft^2$ |

A permeable anisotropic woven geotextile fabric in accordance with an embodiment of the present invention meets the following Minimum Average Roll Values when tested with the standardized methods listed below in Table 5.

TABLE 5

| Property | Test Method | Value (English Units) |
|---|---|---|
| Weave | Visual | Plain Weave Double Pick |
| Machine Direction Yarn | ASTM D-1907 | 1,350 denier monofilament PP |
| Transverse Direction Yarn | ASTM D-1907 | 3,000 denier fibrillated PP |
| Grab Tensile Strength | ASTM D-4632 | 500 lbs (MD) × 200 lbs (TD) |
| Wide Width Tensile Strength | ASTM D-4595 | 4,300 lbs/ft (MD) × 2,900 lbs/ft (TD) |
| Wide Width Elongation | ASTM D-4595 | 11% (MD) × 9% (TD) |
| CBR Puncture | ASTM D-6241 | 1,800 lbs |
| Mullen Burst | ASTM D-3786 | 850 psi |
| Trapezoidal Tear | ASTM D-4533 | 160 lbs (MD) × 125 lbs (TD) |
| UV Resistance (% Retained at 500 Hrs) | ASTM D-4355 | 90% (MD) |
| Apparent Opening Size | ASTM D-4751 | 50 US std sieve |
| Water Flow Rate | ASTM D-4491 | 50 $gal/min/ft^2$ |

A permeable anisotropic woven geotextile fabric in accordance with an embodiment of the present invention meets the following Minimum Average Roll Values when tested with the standardized methods listed below in Table 6.

TABLE 6

| Property | Test Method | Value (English Units) |
|---|---|---|
| Weave | Visual | Plain Weave Double Pick |
| Machine Direction Yarn | ASTM D-1907 | 1,350 denier monofilament PP |
| Transverse Direction Yarn | ASTM D-1907 | 4,600 denier fibrillated PP |
| Grab Tensile Strength | ASTM D-4632 | 534 lbs (MD) × 283 lbs (TD) |
| Wide Width Tensile Strength | ASTM D-4595 | 5,070 lbs/ft (MD) × 3,500 lbs/ft (TD) |
| Wide Width Elongation | ASTM D-4595 | 10.1% (MD) × 8.1% (TD) |
| CBR Puncture | ASTM D-6241 | 1,886 lbs |
| Mullen Burst | ASTM D-3786 | 778 psi |
| Trapezoidal Tear | ASTM D-4533 | 197 lbs (MD) × 170 lbs (TD) |
| UV Resistance (% Retained at 500 Hrs) | ASTM D-4355 | 90% (MD) |
| Apparent Opening Size | ASTM D-4751 | 50-70 US std sieve |
| Water Flow Rate | ASTM D-4491 | 18 gal/min/ft$^2$ |

Although the strength of the machine direction yarns remains constant along the height of the sediment-control fence 5 in accordance with an embodiment of the present invention, selected machine-direction yarns may be provided with different colors or appearances. For example, different colored machine direction yarns may be located at heights corresponding to the height of the center of pressure at overtopping, the height of the center of pressure at half overtopping, the height adjacent to an upper edge of the sediment-control fence and/or the height at or above the midpoint between the upper edge of the sediment-control fence and the height of the center of pressure at overtopping, which heights are described above. In this embodiment, although the machine-direction yarns of the colored bands have the same mechanical properties as the non-colored machine-direction yarns of the sediment-control fence fabric, the colored bands may provide guidance for the placement of staples or other fasteners during installation of the sediment-control fences.

Figure 3:
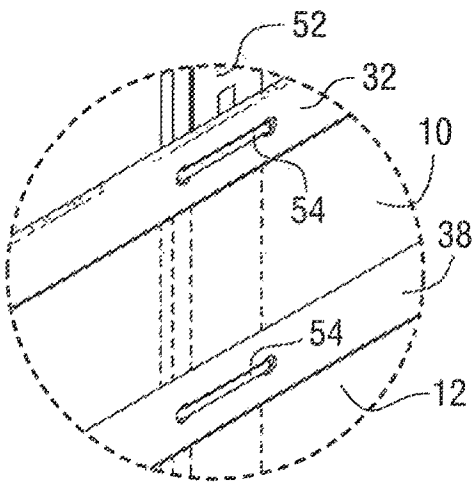
FIG. 3 is a magnified portion of FIG. 2 showing the sediment-control fence secured to an anchoring post using a fastener.

As shown in FIGS. 1, 2 and 3, the anisotropic geotextile fabric 10 of the sediment-control fence 5 may be secured to anchoring posts 52 with fasteners 54. The anchoring posts 52 may have a height configured to receive the sediment-control fence 5. The anchoring post 52 may be made of any suitable material such as metal, wood, plastic and the like. A portion of the anchoring post 52 may be installed below grade in the trench. In certain embodiments, the fasteners 54 are inserted through at least one of the marking stripes 32, 34, 36 and 38 of the sediment-control fence 5 using any suitable means and passed around the anchoring post 52.

Alternatively or in addition, the fasteners 54 may be inserted through any portion of the anisotropic geotextile fabric 10 of the sediment-control fence using any suitable means and passed around the anchoring post 52. The fasteners 54 used to attach the sediment-control fence 5 to the anchoring post 52 may comprise a staple with two pointed legs. The pointed legs allow for the legs of the staple to be inserted through the anisotropic geotextile fabric 10 at the locations of the marking stripes 32, 34, 36 and 38, if desired. Alternatively, wire, zip-ties, clips, hooks, nails, screws, snaps, pins, rings, and the like may be used to attach the sediment-control fence to the anchoring posts 52. For example, stainless steel wire or nylon zip-ties.

In accordance with certain embodiments, the sediment-control fence may be installed according to the following process. A trench having a width and depth may be excavated. For example, the trench width (not shown) may be from about 2 to 8 inches, and the trench depth (not shown) may be from 2 to 12 inches. A plurality of anchoring posts having a distance apart may then be driven into the trench. For example, distance between anchoring posts may range from 2 to 20 feet, or from 3 to 15 feet, or from 4 to 10 feet. The sediment-control fence may then be laid out along the trench with the first end next to a first anchoring post and the second end next to the end anchoring post. The bottom portion of the sediment-control fence is then placed in the trench. In a certain embodiment, after the bottom portion of the sediment-control fence is placed in the trench, the anchoring guide line intersects the ground surface. The sediment-control fence may then be attached to the first anchoring post. The sediment-control fence may then be pulled tight in the direction of the adjacent anchoring post in preparation for attaching the fence to the anchoring post. Sediment-control fence may then be attached to the adjacent anchoring post. This attachment process may then be repeated for every anchoring post until the end anchoring post is reached. Sediment-control fence may then be attached to the end anchoring post.

In accordance with certain embodiments, the sediment-control fence may be secured to the anchoring post according to the following process. A fastener is inserted through the sediment-control fence using any suitable means and passed around the anchoring post mounted in the ground. In accordance with another embodiment of the present invention, the fastener may be inserted through the sediment-control fence at any height along the upper portion height $H_{UP}$ of the sediment-control fence, e.g., at the height of the center of pressure at overtopping, the height of the center of pressure at half overtopping, etc. A fixture (not shown) with two holes may then mounted to the legs of the fastener and rotated by a hand tool to secure the fastener around the anchoring post. Alternatively, any other suitable type of hand operated tool or power tool may be included, such as a power drill with a rotatable fixture. In accordance with certain embodiments, this process is then repeated with at a second fastener at a second location along the height $H_{UP}$ of the sediment-control fence. In addition, the process may be repeated for additional fasteners at additional locations.

In accordance with a further embodiment of the present invention, post-tensioning may be performed prior to driving the first anchoring post into the ground. The sediment-control fence may be secured to the first anchoring post by rotating the first post several times, wrapping the sediment-control fence tightly around the first anchoring post. The first anchoring post may then be driven into the trench. Next, the sediment-control fence may be pulled taut across a length of 10 feet to 20 feet of the fence and secured to a pre-installed anchoring post. This installation process may be repeated for every 10 to 20 feet of the sediment-control fence until the end anchoring post is reached. The sediment-control fence may be secured to the end anchoring post by rotating the end anchoring post several times, wrapping the sediment-control fence tightly around the end anchoring post prior to driving the end anchoring post into the ground. The end anchoring post may then be driven into the trench.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application and the appended claims, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A sediment-control fence comprising an anisotropic fabric having a lower grade line and an upper edge defining an installed height extending between the lower grade line and the upper edge, the anisotropic fabric comprising fibrillated yarn running in a transverse direction substantially parallel with the installed height, and fibrillated yarn running in a machine direction substantially parallel with a length of the anisotropic fabric, wherein a tensile strength of the anisotropic fabric in the machine direction remains substantially constant along the installed height.

2. The sediment-control fence of claim 1, wherein the fibrillated yarn running in the transverse direction and the fibrillated yarn running in the machine direction are woven in a plain weave pattern.

3. The sediment-control fence of claim 2, wherein the plain weave pattern comprises a two-pick weave pattern.

4. The sediment-control fence of claim 1, wherein the fibrillated yarn running in the transverse direction comprises a first fibrillated strand and a second fibrillated strand, and the first and second fibrillated strands have substantially the same denier.

5. The sediment-control fence of claim 1, wherein the fibrillated yarn running in the transverse direction has a denier of from 1,000 to 2,000.

6. The sediment-control fence of claim 1, wherein the fibrillated yarn running in the transverse direction has a tensile strength of from 30 to 60 pounds and an elongation of from 10 to 25 percent.

7. The sediment-control fence of claim 1, wherein the anisotropic fabric comprises from 4 to 20 of the fibrillated yarn running in the transverse direction per inch measured in the machine direction.

8. The sediment-control fence of claim 1, wherein each fibrillated yarn running in the transverse direction has a width of from 0.08 to 0.3 inch.

9. The sediment-control fence of claim 1, further comprising at least one marking stripe running along the length of the anisotropic fabric having an appearance different from an appearance of a remainder of the anisotropic fabric.

10. The sediment-control fence of claim 9, wherein the at least one marking stripe is non-reinforcing.

11. The sediment-control fence of claim 10, wherein the at least one marking stripe is located at a height between the lower grade line and the upper edge corresponding to a height of the center of pressure at overtopping.

12. The sediment-control fence of claim 11, comprising another one of the marking stripes located at a height between the lower grade line and the upper edge corresponding to a height of the center of pressure at half overtopping.

13. A sediment-control fence system comprising:

anchoring posts; and a sediment-control fence for attachment to the anchoring posts comprising an anisotropic fabric having a lower grade line and an upper edge defining an installed height extending between the lower grade line and the upper edge, the anisotropic fabric comprising fibrillated yarn running in a transverse direction substantially parallel with the installed height, and fibrillated yarn running in a machine direction substantially parallel with a length of the anisotropic fabric, wherein a tensile strength of the anisotropic fabric in the machine direction remains substantially constant along the installed height.

14. The sediment-control fence system of claim 13, wherein the fibrillated yarn running in the transverse direction and the fibrillated yarn running in the machine direction are woven in a double pick plain weave pattern.

15. The sediment-control fence system of claim 13, wherein at least one marking stripe having an appearance different from an appearance of a remainder of the anisotropic fabric runs along the length of the anisotropic fabric at a location corresponding to an attachment point between the anisotropic fabric and at least one of the anchoring posts.

16. The sediment-control fence system of claim 15, wherein the at least one marking stripe is non-reinforcing.

17. The sediment-control fence system of claim 16, wherein the at least one marking stripe is located at a height between the lower grade line and the upper edge corresponding to a height of the center of pressure at overtopping.

* * * * *